US006028514A

United States Patent [19]

Lemelson et al.

[11] Patent Number: 6,028,514

[45] Date of Patent: Feb. 22, 2000

[54] PERSONAL EMERGENCY, SAFETY WARNING SYSTEM AND METHOD

[76] Inventors: Jerome H. Lemelson, deceased, late of Incline Village, Nev.; Robert D. Pedersen, 7808 Glenneagle, Dallas, Tex. 75248; by Dorothy Lemelson, executrix, Unit 802, Suite 286, 930 Tahoe Blvd., Incline Village, Nev. 89451

[21] Appl. No.: 09/183,361

[22] Filed: Oct. 30, 1998

[51] Int. Cl.[7] ..... G08B 1/08; G08B 5/22

[52] U.S. Cl. ..... 340/539; 340/573.1; 340/825.36; 340/825.49; 128/903; 600/300; 342/357; 379/38

[58] Field of Search ..... 340/539, 531, 340/825.36, 825.49, 573.1; 128/903, 904; 600/300; 342/357, 457; 379/37, 38; 702/19

[56] References Cited

U.S. PATENT DOCUMENTS

| | | | |
|---|---|---|---|
| 4,662,544 | 5/1987 | Bially et al. | 340/636 |
| 4,887,291 | 12/1989 | Stillwell | 379/39 |
| 4,956,857 | 9/1990 | Kurosaki | 378/110 |
| 4,993,059 | 2/1991 | Smith et al. | 379/39 |
| 5,119,102 | 6/1992 | Barnard | 342/357 |
| 5,119,504 | 6/1992 | Durboraw, III | 455/54.1 |
| 5,182,566 | 1/1993 | Ferguson et al. | 342/357 |
| 5,187,805 | 2/1993 | Bertiger et al. | 455/12.1 |
| 5,202,829 | 4/1993 | Geir | 364/449 |
| 5,223,844 | 6/1993 | Mansell et al. | 342/357 |
| 5,225,842 | 7/1993 | Brown et al. | 342/357 |
| 5,243,652 | 9/1993 | Teare et al. | 380/21 |
| 5,247,440 | 9/1993 | Capurka et al. | 364/424.05 |
| 5,278,539 | 1/1994 | Lauterbach et al. | 340/539 |
| 5,311,197 | 5/1994 | Sorden et al. | 342/457 |
| 5,323,322 | 6/1994 | Mueller et al. | 364/449 |
| 5,334,974 | 8/1994 | Simms et al. | 340/990 |
| 5,345,244 | 9/1994 | Gildea et al. | 342/357 |
| 5,359,332 | 10/1994 | Allison et al. | 342/357 |
| 5,379,224 | 1/1995 | Brown et al. | 364/449 |
| 5,382,958 | 1/1995 | FitzGerald | 342/386 |
| 5,389,934 | 2/1995 | Kass | 342/357 |

(List continued on next page.)

OTHER PUBLICATIONS

Bezdek, Jim, "Fuzzy Models—What Are They, and Why?", *IEEE Technology Update Series, Fuzzy Logic Technology and Applications,* (1992), pp. 3–7.

(List continued on next page.)

*Primary Examiner*—Donnie L. Crosland
*Attorney, Agent, or Firm*—Steve G. Lisa

[57] ABSTRACT

A comprehensive system and method for monitoring a geographic person location, periodically warning a person of emergency situations in the geographic location, and transmitting requests for assistance in emergency situations. The system comprises a warning unit 12 that is carried by the person or that is located in mobile units 20 or in buildings or houses 19. The warning unit 12 includes a geographic satellite receiver 38, a receiver circuit that receives broadcast warning signals defining dangerous situations and geographic locations of the situations, a computer controller including a processor 42 and a memory 44, an alarm indicator 64 or 66 that indicates when the person is in danger, and a transmission circuit that generates and transmits signals requesting assistance and signals warning of the dangerous situations in a vicinity of the person carrying the portable warning unit 12 along with the current geographic location of the person. The system further comprises a command center 10. The command center 10 includes a database computer 102 having a database storage unit 104, a transmitter for broadcasting signals to the unit(s) 12, a receiver for receiving signals, a transmitter for transmitting signals to emergency response units and centers, and other such communication devices. The system uses the unit(s) 12 to monitor and communicate with the person using it. The unit(s) 12 interfacingly communicate with the command center 10. Signals indicative of a dangerous situation and a geographic situation location are transmitted from the command center 10 to the unit(s) 12. The geographic person location is compared with the geographic situation location indicated in the received signal from the command center 10. Expert system rules are used to determine the dangerous situation and a degree(s) of danger index for the person(s) near or at the geographic situation location.

43 Claims, 9 Drawing Sheets

U.S. PATENT DOCUMENTS

| | | | |
|---|---|---|---|
| 5,390,125 | 2/1995 | Sennott et al. | 364/449 |
| 5,396,540 | 3/1995 | Gooch | 379/59 |
| 5,408,238 | 4/1995 | Smith | 342/357 |
| 5,414,432 | 5/1995 | Penny, Jr. et al. | 342/357 |
| 5,415,167 | 5/1995 | Wilk | 128/653.1 |
| 5,418,537 | 5/1995 | Bird | 342/357 |
| 5,422,813 | 6/1995 | Schuchman et al. | 364/449 |
| 5,422,816 | 6/1995 | Sprague et al. | 364/449 |
| 5,430,656 | 7/1995 | Dekel et al. | 364/449 |
| 5,434,787 | 7/1995 | Okamoto et al. | 364/449 |
| 5,438,337 | 8/1995 | Aguado | 342/357 |
| 5,576,952 | 11/1996 | Stutman et al. | 364/413.02 |
| 5,636,245 | 6/1997 | Ernst et al. | 375/359 |
| 5,652,570 | 7/1997 | Lepkofker | 340/573 |
| 5,705,980 | 1/1998 | Shapiro | 340/539 |
| 5,712,619 | 1/1998 | Simkin | 340/539 |
| 5,731,757 | 3/1998 | Layson, Jr. | 340/573 |
| 5,742,233 | 4/1998 | Hoffman et al. | 340/573 |

OTHER PUBLICATIONS

Brubaker, "Fuzzy Operators", EDN, Nov. 9, 1995, pp. 239–241.

Gottwald, Siegred, *_Fuzzy Sets & Fuzzy Logic: The Foundation of Application—Froma Mathematical Point of View,* Vrueg & Sohn, Braunschweig Wiesboden (1993), ISBN 3–528–05311–9. pp.. 133–168.

Hurn, Jeff, *GPS—A Guide to the Next Utility,,* Trimble Navigation (1989), pp. 7–12.

Hurn, Jeff, *Differential GPS Explained,* Trimble Navigation (1993), Chapters 2–3, pp. 5–15.

Jang, Jyh–Shing Roger, Sun,Chen–tsai, "Neuro–Fuzzy Modeling and Control", Proceedings of the IEEE, vol. 83, No. 3, Mar. 1995, pp. 378–406.

Kosko, Isaka, "Fuzzy Logic", *Scientific American,* Jul. 1993, pp. 76–81.

Mendel, Jerry M., "Fuzzy Logic Systems for Engineering: A Tutorial", Proceedings of the IEEE, vol. 83, No. 3, Mar. 1995, pp. 345–377.

Schwartz, Klir, "Fuzzy Logic Flowers in Japan", IEEE Spectrum, Jul. 1992, pp. 32–35.

Logsdon, Tom, *The Navstar Global Positioning System,* International Thomson Publishing (1992), Chapter 2, pp. 18–33.

Leick, Alfred, *GPS Satellite Surveying,* John Wiley & Sons, Inc. (1995), Chapter 3, pp. 58–92.

Cox, "Fuzzy Fundamentals", IEEE Spectrum, Oct. 1992, pp. 58–61.

Stationary Units / Mobile Units
Telecommunications and Paging Satellites
Portable Alarm Units
Transceiver
Pre-Processor
Audio Input
Microphone
Audio Output
Speaker
Display Processor
Display Terminals
Control Processor
Memory
Database Computer
Intelligent Database Storage
Communication Processor
Communication Links
10
70
72
74
76
78
84
86
88
90
92
94
96
98
100
102
104
106
108
110
112
114
116
118
120
122
124

| | A | B | C | D | E | F |
|---|---|---|---|---|---|---|
| 1 | 10 | 10 | 10 | 10 | 0 | 0 |
| 2 | 10 | 100 | 1,000 | 1,000 | 100 | 0 |
| 3 | 10 | 100 | 1,000 | 1,000 | 100 | 10 |
| 4 | 0 | 10 | 100 | 100 | 100 | 10 |
| 5 | 0 | 0 | 10 | 10 | 0 | 0 |

FIG. 7

PERSONAL EMERGENCY, SAFETY WARNING SYSTEM AND METHOD

FIELD OF INVENTION

These inventions relate to emergency warning systems and methods, and, in particular, to systems and methods that have the capability to automatically warn individuals of a variety of types of emergencies in their immediate vicinity.

BACKGROUND OF THE INVENTION

Personal safety is a problem of increasing concern in our society. Individuals face danger and emergency situations in their homes, at their places of work and while traveling in automobiles, trains, airplanes and other forms of transportation. Dangerous situations exist in our cities and on our roadways. Citizens are frequently victims of crime and placed in dangerous situations caused by riots and other civil unrest. Violent weather conditions, earthquakes, pollution hazards, fires, tornadoes, floods, hurricanes, and other natural disasters cause dangerous situations. In addition to these dangerous situations, individuals may require emergency assistance for medical reasons, personal injuries, abandonment, or other personal crises. All these situations give rise to the need for improved personal warning and emergency safety systems not only to alert citizens as they move about in their daily activities but also to provide the capability for individuals to call for emergency assistance when they are in potentially dangerous situations, so that they may avoid or avert dangerous situations.

In our co-pending application, U.S. patent application Ser. No. 08/844,029 filed on Apr. 17, 1997, incorporated herein by reference, applicants describe a danger warning emergency response system and method for warning citizens of dangerous situations that may exist within certain geographic areas as determined by, among other things, the G.P.S. coordinates of those areas. In that system, individuals carry emergency warning units complete with G.P.S. receivers to receive location signals from G.P.S. satellites and telecommunication receivers to receive signals transmitted by a paging or other communication networks from central emergency warning centers. The individual warning units carried by persons throughout the area receive the transmitted danger warning signals. Based on an individual's present G.P.S. coordinates, the warning unit computes whether or not the individual is currently within a dangerous area. The portable emergency warning unit generates appropriate warning signals and messages to alert the person or persons associated with that unit of the dangerous situations and the degree of danger. Fuzzy logic, expert systems and other methods are described in our co-pending application to characterize dangerous situations and formulate appropriate messages for transmission.

Several prior art patents address different aspects of tracking individuals using G.P.S. and warning individuals of danger. For example, it is known to use G.P.S. technology to track individuals. See, e.g., U.S. Pat. Nos. 5,742,233; 5,712,619; 5,731,757. These prior art patents are incorporated herein by reference. It is also known to use G.P.S. technology and personal warning devices to request help when an individual is in distress. See, e.g., U.S. Pat. Nos. 5,742,233; 5,712,619. These prior art patents are incorporated herein by reference.

It is also known to use G.P.S. technology and personal warning devices to warn individuals that specific criminal offenders are in the area. See e.g., U.S. Pat. No. 5,731,757. This prior art patent is incorporated herein by reference. U.S. Pat. No. 5,731,757 does not, however, create a comprehensive safety warning system by warning users of varying dangers, such as fires, tornadoes, or police chases. Furthermore, U.S. Pat. No. 5,731,757 is not capable of learning a user's normal behavior.

It is further known to selectively distribute information via radio communications based on location, velocity, and/or time. See, e.g., U.S. Pat. No. 5,636,245. This prior art patent is incorporated herein by reference. However, U.S. Pat. No. 5,636,245 does not use fuzzy logic or expert systems to classify dangerous situations with varying degrees of danger, such as, for example, classifying the degree of danger based on distance from danger and nature of dangerous situations. U.S. Pat. No. 5,636,245 also does not selectively distribute radio communications based upon individual user characteristics, such as a need for a person having a heart condition or problem to be close to a heart trauma center. Furthermore, U.S. Pat. No. 5,636,245 does not warn individuals of varying dangerous situations (i.e., shootings, fires, riots, chemical hazards, etc.).

It is known to determine location and to request police assistance via a paging or radio network. See, e.g., U.S. Pat. Nos. 5,705,980; 5,652,570. These prior art patents are incorporated herein by reference. However, U.S. Pat. Nos. 5,705,980 and 5,652,570 do not use G.P.S. technology to locate individuals.

It is further known to monitor an individual's medical information (i.e., blood pressure, blood chemistry, etc.) and report that information via radio communication to a central control center. See, e.g., U.S. Pat. Nos. 5,576,952; 5,415,167; 5,652,570. These prior art patents are incorporated herein by reference. However, U.S. Pat. Nos. 5,576,952; 5,415,167; 5,652,570 do not use G.P.S. technology to locate individuals in medical distress.

Each of the patents and articles discussed above is incorporated herein by reference.

A significant drawback to all of the inventions discussed above is that they do not create a comprehensive warning system by collecting information from users and distributing that information to other selected users. The above inventions distribute information that is obtained from already existing sources (i.e., weather reports, police radio, etc.). The present invention not only distributes information that it receives from already existing information sources, but it also distributes information that it receives from individual users to other specific users. In addition to creating a system of selectively distributing information, the present invention also creates a new source of information to distribute.

Importantly, none of the above inventions make use of fuzzy logic or expert systems to develop calculated degree of danger indications to further assist persons using the system to better understand the peril and nature of danger that may exist. The use of the fuzzy logic/expert system and methods of applicant's incorporated co-pending application, U.S. patent application Ser. No. 08/844,029 cited above, with the two-way communication and other unique features of the present application, provides a more comprehensive warning system and method.

Another significant drawback of the above prior art inventions is that they are not capable of learning the behavior of the individual users.

Therefore, the need exists for a personal emergency, safety warning system and method that creates a more comprehensive, intelligent warning and response system for individual users.

SUMMARY OF INVENTION

The present invention includes a system for monitoring a person's geographic location. The system periodically warns the person of emergency situations in specific geographic locations. The system also allows people to request assistance while in emergency situations.

The system includes a portable warning unit that is carried by a person. The portable warning unit includes a satellite receiver that receives and analyzes communication signals from a satellite positioning system and determines the current geographic location of the person. The portable warning unit also includes a receiver circuit that receives broadcasted warning messages defining dangerous situations and the geographic locations of those situations. The portable warning unit also includes a computer controller including a processor and a memory. The processor is configured to monitor and store in memory data defining the geographic location of the person as the person moves from location to location over a period of time. The processor also compares the geographic location of the person with the location information in the received warning signals to determine the degree of danger for the person carrying the portable warning unit. The portable warning unit also includes an alarm indicator that indicates when the person is in danger. In addition, the portable warning unit includes a transmission circuit that generates and transmits signals requesting assistance and signals warning of dangerous situations in the vicinity of the person carrying the portable warning unit along with the current geographic location of the person.

The present invention also includes a command center. The command center includes a database computer that has a database storage unit. The database computer is configured to monitor and track the existence and status of emergency situations. The database computer is also configured to monitor the locations of emergency response centers and units in a geographic region. The command center also includes a transmitter for broadcasting emergency warning signals corresponding to dangerous situations along with the geographic locations of those situations. The command center also includes a receiver for receiving emergency assistance requests and signals indicating the existence of dangerous situations. The command center also includes a transmitter for transmitting signals to emergency response units and centers.

During operation of the present invention, the receiving circuit of the portable warning unit carried by the person receives the signals transmitted from the command center that are indicative of a dangerous situation and the geographic location. The computer controller of the portable warning unit compares the geographic location of the person carrying the unit with the location of the dangerous situation indicated in the received signal from the command control center. Using expert system rules, the computer controller of the warning unit determines a degree of danger index for the person carrying the portable warning unit. If necessary, the computer controller generates a warning signal for the person carrying the warning unit. The portable warning unit generates and transmits signals requesting emergency assistance and warning of emergency situations along with signals indicating the location of the portable warning unit.

The present invention includes a plurality of portable warning units carried by a plurality of persons. The command center is configured to broadcast warning signals that are simultaneously received by all portable warning units within radio signal range of the command control center.

The present invention uses a satellite positioning system which may be a Global Positioning System (G.P.S.). The satellite receiver of the warning unit is compatible with the Global Positioning System and the current geographic position of the person is defined by the person's G.P.S. coordinates.

The computer controller of the portable warning unit generates and stores data defining the normal behavior patterns of the person wearing the unit in the memory of the computer controller. The computer controller of the portable warning unit compares the data stored in memory defining the normal behavior patterns to the data defining the current geographic location of the person wearing the warning unit, and if a predefined variance exists between the current geographic location and normal behavior patterns, an alarm signal is generated and transmitted to the command control center.

The controller of the warning unit generates and stores data defining dangerous areas for persons to travel. The computer controller of the warning unit compares the data stored in memory defining the dangerous areas to the data defining the current geographic location of the person wearing the warning unit, and if the person is in a dangerous area, an alarm signal is generated and a request for assistance is transmitted to the command control center. In addition, the computer controller of the warning unit compares the data stored in memory defining the dangerous areas to the data defining geographic locations that the person wearing the warning unit frequently visits. If it is probable that the person will visit dangerous areas, an alarm signal is generated for the person wearing the warning unit.

The warning unit carried by the person further includes a medical monitoring system that monitors and generates signals defining selected current medical conditions of the person wearing the warning unit. The portable warning unit computer controller memory includes data defining abnormal medical conditions. The computer is programmed to compare the signals generated by the medical monitoring system to the data stored in memory defining abnormal medical conditions. If a variance of predefined degree exists between the person's current and normal medical conditions, the computer generates and causes the transmission circuit to transmit signals defining the variance to the command control center. The medical monitoring system detects abnormal medical conditions in the blood, circulatory system, respiratory system, and nervous system. If the medical monitoring system detects abnormal conditions in the user's blood, circulatory system, respiratory system, or nervous system, the medical monitoring system alerts the command control center of the user's location and condition. The command control center determines the severity of the emergency and dispatches the proper emergency assistance. The portable warning unit carried by the person further includes a sound recognition system configured to recognize and generate electrical signals defining selected sounds. The computer controller memory includes data defining select emergency conditions based on sounds. The computer is programmed to compare the signals generated by the sound recognition system to the data stored in memory defining select emergency conditions based on sounds. If a select emergency condition exists, the computer generates and causes the transmission circuit to transmit signals defining the emergency condition to the command control center. The sound recognition system contains a speech recognition circuit. The sound recognition system detects specific pre-programmed speech. If pre-programmed speech is detected, the warning unit alerts the central command center that the individual may be or is in distress. The central command center then dispatches appropriate assistance to the individual in distress. The sound recognition system detects loud noises, riot sounds, gunshots, and other such noises. If such noises are detected, the warning unit alerts the central command center, and the central command center dispatches the appropriate assistance to the individual in distress. The command control center receives the transmitted signals from the portable warning unit and uses fuzzy logic to define the emergency condition. The command control center generates and transmits signals to an emergency response unit defining the type of emergency, the fuzzy logic degree of danger and the current geographic location of the user. The command center also transmits warning messages based on information received from weather reports, police radio, and other auxiliary information sources. In addition, the command center transmits warning messages to persons carrying warning units based on information received from other persons carrying portable warning units.

The controller of the warning unit generates and stores data defining dangerous types of motion based on received G.P.S. signals. The dangerous motion recognition system detects dangerous acceleration, elevation, speed, and deceleration. If dangerous acceleration, elevation, speed, or deceleration is detected, the warning unit alerts the central command center, and the central command center dispatches appropriate assistance to the individual that may be or is in distress.

The computer controller of the portable warning unit's expert system comprises fuzzy logic inference rules and a fuzzy logic controller to compute a degree of danger index for the person carrying the portable warning unit. The fuzzy logic inference rules include fuzzy variables defining the distance between the portable warning unit and the dangerous situation, vulnerability of the person carrying the portable warning unit to the dangerous situation, and the relative velocity between the portable warning unit and the dangerous situation. The fuzzy logic controller derives a fuzzy variable defining the degree of danger of the person carrying the portable warning unit and defuzzifies that variable to derive a singular degree of danger.

It is therefore an object of this invention to provide new and useful personal emergency safety warning systems and methods that provide a compact, electronic personal emergency safety warning unit to be carried by persons or provided in homes, buildings, automobiles or the like to warn users of dangerous situations in surrounding areas and to permit transmission of requests for assistance when dangerous or emergency conditions are encountered.

It is a further object of this invention to incorporate G.P.S. location technology in a personal emergency safety warning unit to permit calculation of exact location of the unit on the earth, compare that location to broadcast danger warning messages, and based on that comparison, warn the user of a dangerous situation or situations in the vicinity.

It is a further object of this invention to incorporate G.P.S. location technology in a personal emergency safety warning unit to permit calculation of exact location of the unit on the earth, compare that location to locations that the user of the warning unit frequently visits, and based on that comparison, warn the user of a dangerous situation or situations in those area or areas.

It is a further object of this invention to incorporate G.P.S. location technology in a personal emergency safety warning unit to permit calculation of exact location of the unit on the earth, compare that location to the location of emergency medical centers, and based on that comparison, warn the user that he/she is dangerously far away from an emergency medical center that may be necessary for that user's particular condition.

It is another object of this invention to incorporate G.P.S. location technology in a personal emergency safety warning unit to permit calculation of exact location of the unit on the earth and save that location to an intelligent database; thus, enabling the system to learn the traveling behavior of the user of the warning unit.

It is a further object to provide sensor technology in a personal emergency safety warning unit to permit detection and analysis of medical emergencies for the user, such as heart attacks, strokes, respiratory problems, low blood pressure, etc., and to broadcast requests for assistance based on that emergency or emergencies and the respective G.P.S. coordinates.

It is a further object of this invention to provide sensor technology in a personal emergency safety warning unit to permit detection, analysis and recognition of spoken words with transmission of requests for responses or for assistance when selected words or commands are detected.

It is yet a further object to provide sensor technology in a personal emergency safety warning unit to permit detection, analysis, and recognition of unusual or predetermined sounds, such as riot sounds, gunshots, loud noises, etc. and to transmit a request for assistance when such sounds are detected.

It is yet another object to provide sensor and/or G.P.S. coordinates calculation technology in a personal emergency safety warning unit to permit detection, analysis and recognition of dangerous types of motion such as unusual or unexpected changes in location, velocity, acceleration, or deceleration of the warning unit and to transmit requests for assistance when such events are detected.

It is still another object of this invention to provide the above detection and analysis of motion dynamics combined with the speech and sound analysis to detect combinations of events requiring the generation of requests for responses or for assistance.

It is a further object of this invention to combine the above capabilities in an integrated, unique personal emergency safety warning unit using common implementations for several operations, thereby reducing unit cost, size and complexity while still providing comprehensive warning and alarm capabilities.

Further objects of the invention are apparent from reviewing the summary of the invention, detailed description, and claims set forth below.

The above and other objects are achieved by adding an emergency response capability to the previous danger warning systems and methods of applicant's co-pending U.S. patent application Ser. No. 08/844,029 thereby enabling an individual to transmit requests for assistance when in a dangerous situation. Such transmissions may be independent of any received messages and provide the capability for individuals to broadcast a request for help along with their G.P.S. coordinates so that emergency assistance may be properly dispatched.

The present personal emergency safety warning system and method includes speech recognition capability to permit the portable unit to recognize particular phrases or words such as, "help," "robbery," "rape," "medical alert," or other specific phrases descriptive of the emergency situation that may be used in an emergency control center to more properly respond to the emergency situation.

The above and other objects are also achieved by enabling the present personal emergency safety warning system and method to recognize other sounds indicative of particular emergency situations such as gun shots, screeching tires, or loud sounds such as screaming, road noise, crowd noise, riot sounds, or other sounds indicative of dangerous situations. Based on the detection of such words or alarming sounds, emergency transmissions are made from the personal monitoring unit to a remote control center along with the G.P.S. coordinates of the monitoring system to request appropriate assistance for the individual in peril.

The above and other objects are also achieved by enabling the present personal emergency safety warning system and method to detect different forms of alarming motion such as abnormally high speeds, abnormally high accelerations, sudden changes in elevation (i.e. falling of a cliff), or abnormal decelerations (i.e. car accidents). Unexpected or unusual changes in location may also be detected as a reason for alarm.

The present invention also has the capability to learn the traveling behavior of the individual users of the warning unit. For example, if a person travels to a new and unusual location, the warning unit will recognize that the user is not following his/her normal travel pattern and ask the individual if he/she is in any danger. If the individual indicates that he/she is in danger or fails to respond possibly from being abducted or lost, transmissions are made from the personal monitoring unit to a remote control center along with the G.P.S. coordinates of the monitoring system to request appropriate assistance for the individual in peril.

The above and other objects are also achieved by enabling the present personal emergency safety warning system and method to warn users of dangerous situations that exist in areas in which they frequently travel. For example, the safety warning system and method may have learned from observing the user that he/she frequently travels to an area where a homicide or other tragic event just occurred. The present invention will warn the user of the warning unit not to travel to or be cautious at that location because of the danger that is associated with the crime or event that has just occurred.

The above and other objects are also achieved by enabling users of the present personal emergency safety warning system and method to seek emergency medical help. The warning unit has the capability to monitor a person's heart rate, blood pressure, blood sugar level, breathing level, and/or other measurable indicators and medical signs that determine a need for emergency medical attention. It analyzes that data by, among other things, comparing it to medical history data for the user. If the system detects abnormal medical signs for an individual and the individual is in need of medical attention, an emergency transmission is made from the personal monitoring unit to a remote control center along with the G.P.S. coordinates of the monitoring system to request appropriate medical assistance. The emergency transmission is automatically generated by the warning unit based on the information that it gathers, or it is manually generated by the person associated with the warning unit. The present invention also uses G.P.S. technology to inform an individual associated with a warning unit that he/she is located dangerously far away from an emergency medical center. This feature is especially beneficial to people who are in poor health and must stay in close proximity to a hospital.

The above and other objects are also achieved through a centralized, intelligent database that contains pertinent information about the users of the warning units. The database may contain a physical description, medical history, family information, etc. about each individual carrying a warning unit. The database is not only capable of identifying an individual transmitting a request for help but is also capable of relaying that individual's data to the proper emergency response teams. For example, if a person in need of medical attention is a diabetic or allergic to certain drugs, the database is able to inform the medical response team of that information before they arrive to the person in need of assistance. The database is also capable of storing learned data about the users of the warning units. For example, the present invention is capable of establishing a normal pattern of traveling behavior for an individual user of a warning unit and comparing the present location of the warning unit against the normal behavior pattern that is stored in the intelligent database. The stored normal pattern of behavior is updated by constantly monitoring the position of the warning unit.

The above and other objects are also achieved by enabling the central control center of the present invention to transmit a paging message or messages along with the G.P.S. coordinates of parties requesting assistance because of a dangerous situation or a medical emergency. All emergency response units in range of the paging message or messages will receive the request One or more such emergency response units may respond to the request for help and be assigned to actually respond by the emergency response control center.

The above and other objects are also achieved by combining the passive danger warning and emergency response capability of the above cited patent application Ser. 08/844,029 with speech recognition, sound recognition, motion detection and medical monitoring capability to enable individuals to request emergency police, fire, or medical assistance from an emergency control center. In addition to being able to receive danger warning messages, individuals are capable of transmitting warnings of dangerous situations or other emergencies. These transmitted warnings are able to then be relayed to other warning units in the same area. Thus, a more comprehensive personal emergency, safety warning system and method is provided that warns individuals of dangerous situations that may be occurring close to their current positions and permits individuals to request specific help based upon a need for medical attention, the utterance of particular words, the detection of sounds, or the detection of unusual movement that is indicative of dangerous situations.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

For example, the disclosed system and method makes use of G.P.S. communication satellites and G.P.S. receivers to determine locations throughout the system. Other navigation systems could likewise be used. Thus, G.P.S. technology is shown and referenced generally throughout this disclosure, and unless specifically noted, is intended to represent any and all devices/technologies appropriate to determine locations.

Likewise, there are disclosed several computers or controllers that perform various control operations. The specific form of computer is not important to the invention. In its preferred form, applicant divides the computing and analysis operations into several cooperating computers or microprocessors. However, with appropriate programming well known to those of ordinary skill in the art, the inventions can be implemented using a single, high power computer. Thus, it is not applicant's intention to limit his invention to any particular form of computer.

Further examples exist throughout the disclosure, and it is not applicant's intention to exclude from the scope of his invention the use of structures, materials, or acts that are not expressly identified in the specification, but nonetheless are capable of performing a claimed function.

BRIEF DESCRIPTION OF THE DRAWINGS

The inventions of this application are better understood in conjunction with the following drawings and detailed descriptions of the preferred embodiments. The various hardware and software elements used to carry out the invention are illustrated in the attached drawings in the form of block diagrams, flow charts, and other illustrations.

FIG. 7 is a grid diagram illustrating how the present invention monitors the location of the warning unit and updates the intelligent database.

DETAILED DESCRIPTION OF THE DRAWINGS

Figure 1:
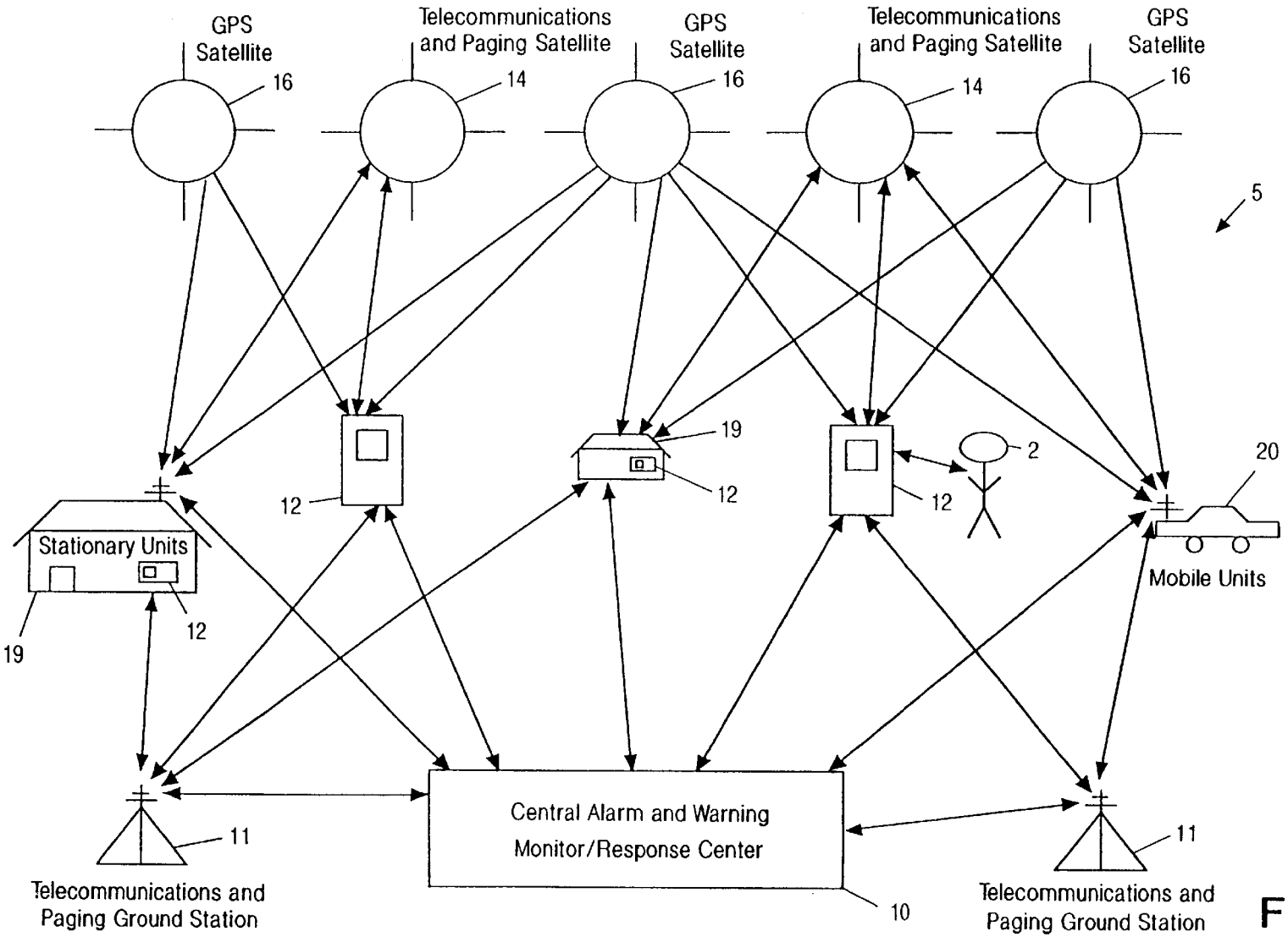
FIG. 1 is a diagram illustrating the overall personal emergency and safety warning system and method.

FIG. 1 illustrates a preferred embodiment of a personal emergency and safety warning system and method in accordance with the present invention. The central alarm and warning monitor/response center 10 interrelates and communicates with the various system elements to form a comprehensive personal emergency and safety warning system. Individual warning units 12 communicate by a radio or wire line links with the central alarm and warning monitor/response center 10. The warning units 12 receive G.P.S. coordinate signals from G.P.S. satellites 16 to permit precise calculation of geographic G.P.S. coordinates of the respective units 12 by the monitor/response center 10. The individual warning units 12 also receive communication signals from the telecommunications and paging satellites 14 that are used to relay communications from the monitor/response center 10. Warning units 12 also receive communications from the monitor/response center 10 via the telecommunications and paging ground stations 11 in the manners illustrated in FIG. 1. As illustrated in FIG. 1, the warning units 12 are carried by individual persons or are located in buildings or houses 19 or in mobile units 20. In operation, request for emergency assistance is generated by the warning units 12 in response to a detected emergency, by the persons carrying the warning units 12, by the persons located in mobile units 20, or by the persons located in buildings or houses 19 as illustrated in FIG. 1.

The request for emergency assistance is generated by various methods. Some of these methods include directly activating the warning units 12, activating the units 12 by detection of a medical emergency (i.e. heart attack, stroke, etc.), activating the units 12 by pre-programmed recognition of spoken words, activating the units 12 by the detection of unusual motion, or activating the units 12 by the detection of dangerous sounds such as gun shots, screaming, or other loud noises. In addition, emergency warning signals are broadcast from a monitor/response center 10 via telecommunications and paging satellites 14 or telecommunications paging ground stations 11. These emergency warning signals are then received by various warning units 12 throughout the system. The warning units 12 calculate their precise geographic location via the G.P.S. coordinate signals received from the G.P.S. satellite 16. Each warning unit 12 then compares its own location coordinates with the coordinates of the dangerous situation received in the emergency warning signal received from monitor/response center 10 and determines whether or not the warning unit 12 is in a dangerous area.

FIG. 1 illustrates that signals may be generated by the individual emergency warning units 12 requesting assistance from the monitor/response center 10. In addition, the individual warning units 12 may receive signals from the monitor/response center 10 with G.P.S. coordinates indicating the location of dangerous situations. These received signals are relayed by the monitor/response center 10 in response to weather conditions, special warning messages received from police or law enforcement officers, or other information indicating dangerous situations that may exist in particular areas. Thus, users of the monitor warning unit 12 are able to request emergency assistance and receive warning messages indicating a dangerous situation in a particular area.

The individual warning units 12 contain G.P.S. coordinate receivers. The individual units 12 use the G.P.S. receivers to determine whether or not they are respectively located within a danger area corresponding to messages received from the monitor/response center 10. Indications of dangerous situations may originate at individual emergency warning units 12, and the information is used to generate general emergency broadcast signals that are received by other various emergency warning units 12 via the telecommunications and paging satellites 14 and/or the telecommunications paging ground stations 11.

Figure 2:
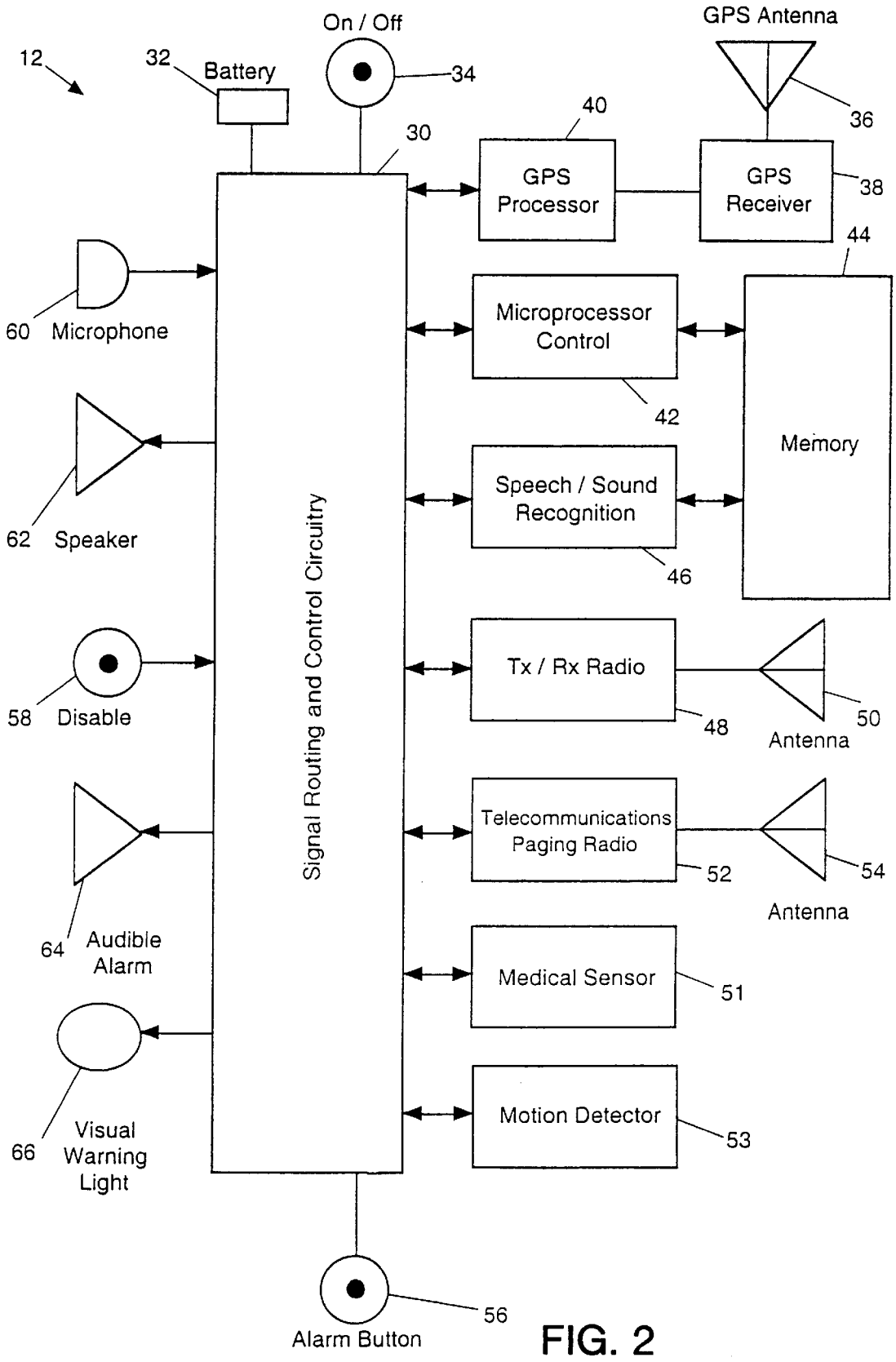
FIG. 2 is a block diagram of a preferred personal emergency warning and safety system unit.

FIG. 2 depicts a comprehensive integrated personal emergency warning and safety system unit 12 that uses a combination of modem communication technology, precise geographic location information derived by G.P.S. satellites, and advanced low cost compact electronics. Signal routing and control circuitry 30 is used to couple the various system elements and are implemented with well known microprocessor and signal multiplexing control circuitry. The signal routing and control circuitry unit 30 is powered by a battery 32 which is replaced or recharged depending on the particular implementation. Personal warning unit 12 is activated with the on/off button 34. Speech signals are input by a microphone 60 which is designed as an integral part of the warning unit 12. The speaker 62 is used to provide spoken commands and directions to users of the unit 12 in response to a request for assistance or in the form of warning signals indicating a dangerous situation. In addition to the speaker 62, an audible alarm 64 is provided that outputs special audible signals such as beeps or siren effects to warn or alert the user of warning unit 12 of a dangerous situation. A visual warning light 66 is also provided to further alert the user. In addition to the on/off button 34, the unit 12 is activated by spoken commands.

Personal warning unit 12 receives G.P.S. signals via the G.P.S. antenna 36 and the G.P.S. receiver 38. The G.P.S. processor 40 is used to compute geographic coordinates of the warning unit 12 based on the received G.P.S. coordinate signals. The microprocessor control 42 along with the memory 44 is used to control the overall operation of the warning unit 12. The microprocessor 42 in conjunction with the memory 44 receive and use the data collected from the G.P.S. processor 40 to learn the normal traveling behavior for the user of warning unit 12. The present invention compares the normal travel behavior of the user of warning unit 12 with the observed location of the warning unit 12 to determine if the user of the warning unit 12 is in a dangerous situation based upon his/her location and, if so, determines the degree of danger that the user may be in. Speech/sound recognition circuit 46 is used for recognition of spoken words or other sounds such as gun shots, screams, or other noises indicative of dangerous situations. Speech/sound recognition circuit 46 is also coupled to the memory 44 as indicated in FIG. 2 to output alarm signals and indications at appropriate times to the microprocessor control 42. FIG. 2 also shows medical sensor 51 used to detect emergency medical conditions and to automatically transmit requests for assistance along with G.P.S. coordinates and specific information about the emergency such as a heart attack, failure to respond to stimuli, etc. The motion detector 53 is in the form of an accelerometer and is used to indicate abnormal rapid changes in movement that may indicate the user is in a dangerous situation. Abnormal changes in location and/or velocity is also computed by monitoring G.P.S. coordinates at fixed or known time intervals. Unexpected changes in position or velocity is considered by the unit 12 as an indication of danger to the user. Such changes in location or motion dynamics is further combined with speech or sound analysis in order to determine and indicate the existence of danger.

Signals are received and transmitted to and from the monitor/response center 10 of FIG. 1 via the transmit/receive (TX/RX) radio 48 and antenna system 50 of FIG. 2. The radio system 48, for example, is in the form of a cellular telephone system or other suitable radio communication devices for communications with telecommunications and paging ground station 11 of FIG. 1. Furthermore, a telecommunications and paging radio 52 with antenna 54 is shown in FIG. 2 for communications with the telecommunications and paging satellites 14 of FIG. 1. In addition to being activated by spoken commands, the warning units 12 of FIG. 2 is activated by the alarm button 56. By simply pushing the button 56, a request for assistance is transmitted to the monitor/response center 10. The disable button 58 of FIG. 2 is used to cancel an alarm signal prior to transmission to avoid false alarms as further explained below.

Figure 3:
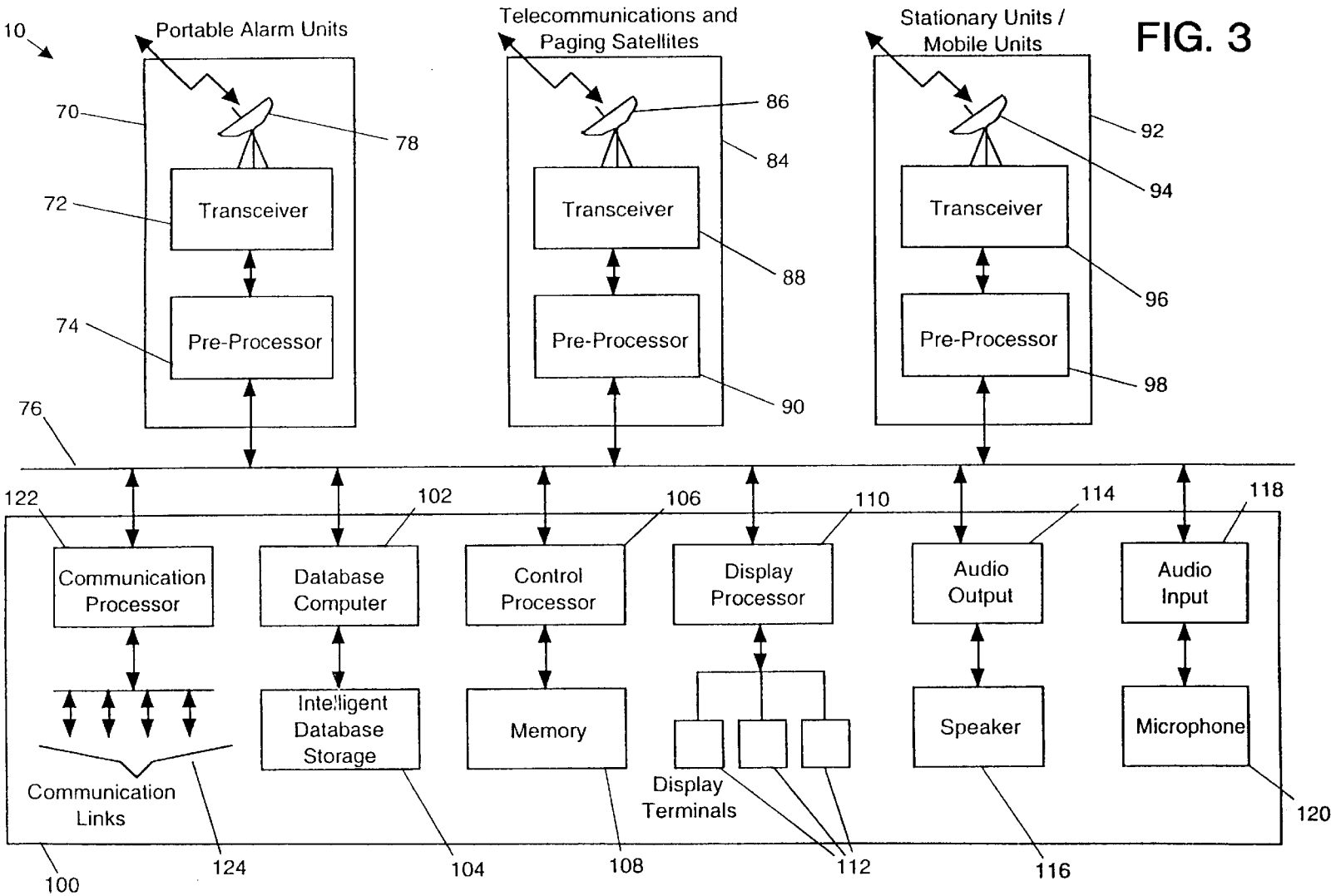
FIG. 3 is a block diagram of a central alarm and warning monitor/response center.

FIG. 3 depicts in block diagram form the structure of the central alarm and warning monitor/response center 10 of FIG. 1. The central alarm warning monitor/response center 10 has the computer control system 100 interrelating and communicating with various communication units. The computer system 100 includes the control processor 106 with its associated memory 108. The computer system 100 monitors and tracks the existence and status of emergency situations and also monitors the locations of emergency response centers and units in a geographic region. The control processor 106 is used to coordinate overall activities monitored by the personal emergency, safety warning units 12 described herein. Operator control is provided along with multiple display terminals 112 interfaced through the display processor 110. A special database computer 102 with database storage 104 is also included in the monitor/response center computer control system 100. The database computer 102 is used to keep track of many remote monitor units 12 as well as the location of the mobile emergency response units 20 of FIG. 1 suitable to respond to various emergency conditions. In addition, the database computer 102 calculates and stores the learned normal traveling behavior of the users of the warning units 12. Audio output is provided through the audio input circuitry 114 and speaker 116. In addition, audio input is provided to the control center 10 by a microphone 120 and audio input circuitry 118 as shown in FIG. 3. The speaker 116 and the microphone 120 enable personnel at control center 10 to communicate directly with users of the warning units 12 of FIG. 1 as well as with emergency response personnel located throughout the network area being served. The computer control system 100 of FIG. 3 also includes communication processor 122 linked by communication links 124 for land based communications to the telecommunication ground stations 11 of FIG. 1 as well as with permanently located monitor units 12 such as illustrated in houses and buildings of FIG. 1. Communication links 124 are standard telephone lines or other suitable communication media including cable systems, light wave system, or various forms of radio communications.

The monitor/response center 10 of FIG. 3 also includes a communication system 70 for communicating with the portable warning units 12 of FIG. 1. The communication system 70 of FIG. 3 includes antenna 78, transceiver (i.e. transmitter/receiver) 72, and pre-processor 74 that are communicatingly coupled with the computer system 100 via the interconnect circuitry 76 as shown in FIG. 3. The interconnect circuitry 76 is implemented using digital bus technologies or various forms of local area networks and communications facilities well known to those skilled in the art. The monitor/response center 10 of FIG. 3 also includes the communication system 84 for communicating with telecommunications and paging satellites 14 of FIG. 1. Communication system 84 comprises the antenna 86, the transceiver (i.e. transmitter/receiver) 88, and the pre-processor 90 also communicatingly coupled to the computer center 100 via the interconnection of circuitry 76 as shown in FIG. 3. FIG. 3 also shows the communication system 92 for communicating with stationary units 19 and mobile units 20 of FIG. 1. Communication system 92 comprises the antenna 94, the transceiver (i.e. transmitter/receiver) 96, and the preprocessor 98 also communicatingly coupled to the computer center 100 via the interconnection of circuitry 76 as shown in FIG. 3.

Figure 4A:
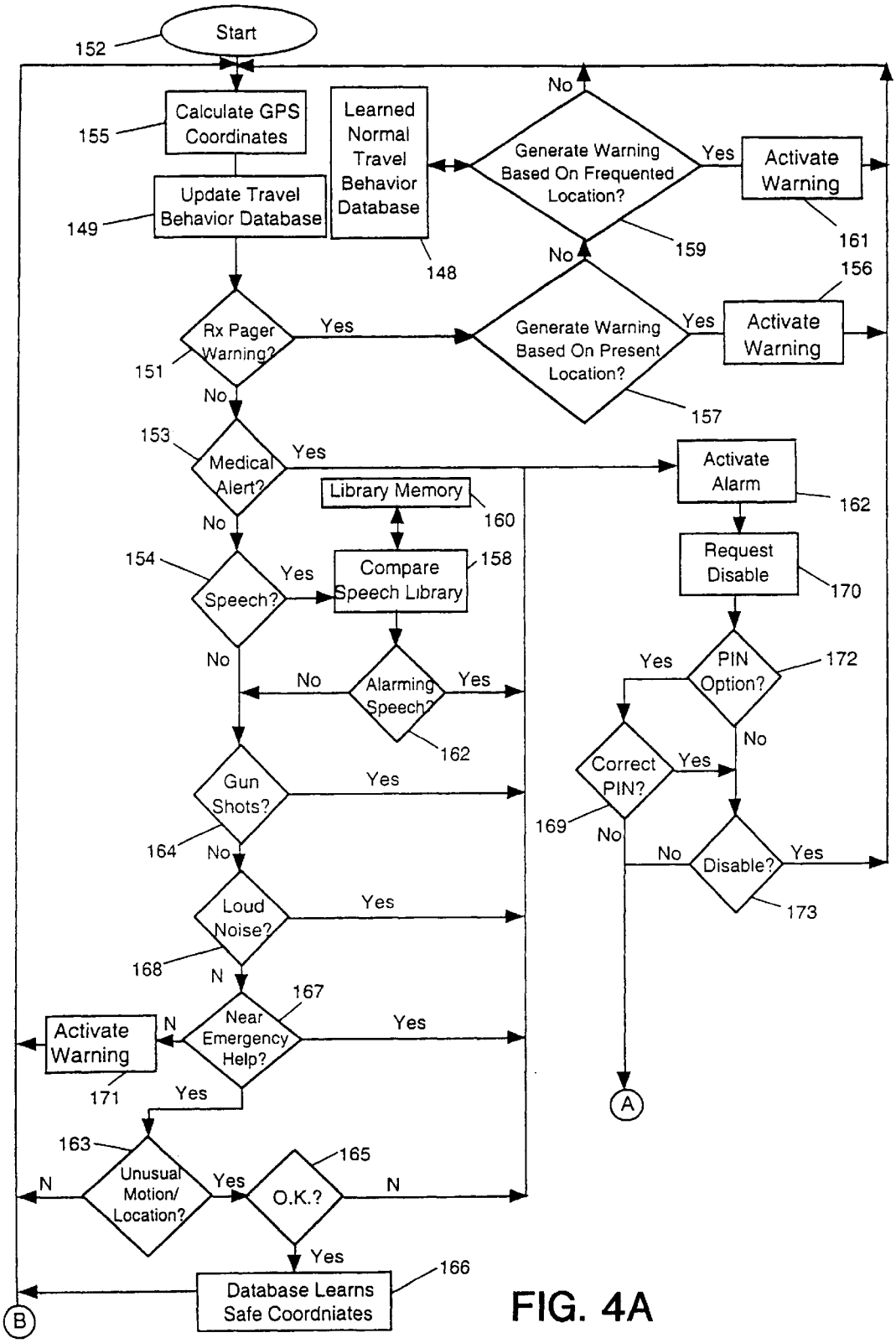
FIGS. 4A and 4B are a high level logic flow chart for the operation of the personal emergency warning and safety unit of FIG. 2.
Figure 4B:
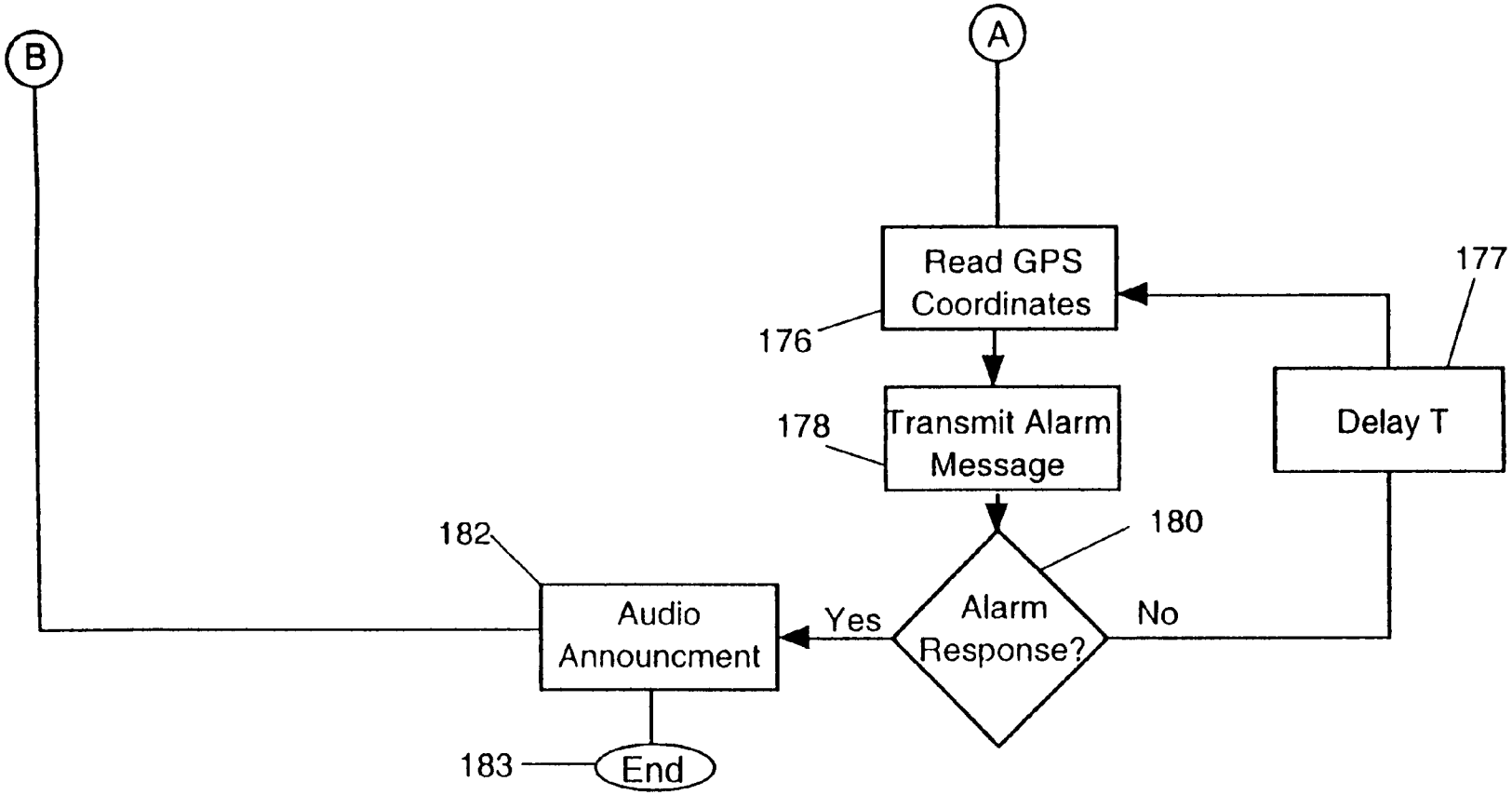

FIGS. 4A and 4B provides a high level block diagram of the logical operation of the personal emergency and safety warning unit 12 illustrated in FIG. 2. The operation of warning unit 12 begins at start block 152. The unit 12 calculates its present G.P.S. coordinates at block 155 and then updates the learned traveling behavior database at block 149. The unit 12 monitors receipt of danger warning pager messages from control center 10 at decision block 151. Such messages indicate the existence of a dangerous situation such as a robbery, rape, civil unrest, traffic problems, weather warnings, etc. At decision block 157, the system determines if a warning message is to be generated by the warning unit 12 based on the proximity of the dangerous situation as determined from the present G.P.S. coordinate location in the received danger warning message and the calculated coordinates of unit 12. If the system determines at decision block 157 that a warning message is to be generated, then a warning is activated by the system to the warning unit 12 that is worn by the user at block 156 and returns control to block 155 to recalculate its G.P.S. coordinates. The alarm produced by warning unit 12 is in the form of an audible alarm, a vibration of warning unit 12, a visible alarm (i.e. a flashing light or strobe), or any combination of the above methods of alarms. If the system determines at decision block 157 that there is no danger to the user of warning unit 12 based on the calculated present G.P.S. coordinate location, then the system passes control to decision block 159 where the unit 12 determines if the user of the warning unit 12 might travel to the dangerous situation based upon his/her learned normal traveling behavior (i.e. frequented locations) which is stored in the learned normal traveling behavior database at block 148. If the system determines at decision block 159 that it is necessary to generate a warning based on determination of a frequented location(s), control is passed to activate warning 161. The alarm produced by warning unit 12 is in the form of an audible alarm, a vibration of warning unit 12, a visible alarm (i.e. a flashing light or strobe), or any combination of the above methods of alarms. If at decision block 159 it is determined that it is not necessary to activate a warning based on non-determination of a frequented location, then control is passed to block 155 to recalculate the G.P.S. coordinates of the unit 12. If a danger (RX) pager warning is not detected at decision block 151, control is passed to medical alert decision block 153.

It is determined whether there is a medical alert at block 153. The medical alert is generated by the person using/carrying the warning unit 12 or by the warning unit 12 itself. The warning unit 12 generates medical alerts when the person's body functions or medical conditions being monitored (i.e. heart rate, blood level, sugar level, circulatory system, respiratory system, nervous system, etc.) reach abnormal levels. If a medical alert is detected, control is passed to activate alarm at block 162. At block 162, audible alarm 64 and/or visual warning light 66 of FIG. 2 is/are activated to notify the carrier/user of warning unit 12 that a request for help is being sent and also to attract attention for immediate medical assistance (i.e. CPR, first aid, etc.) from people in the immediate vicinity of the person using/carrying warning unit 12. After the alarm 64 has been activated, the user of warning unit 12 is given the opportunity to disable the alarm sequence at the request disable block 170. Block 170 in FIG. 4A is a method of avoiding false alarms. At the request disable block 170, the person carrying/using warning unit 12 of FIG. 2 is permitted to disable the alarm signal by depressing disable button 56 as shown in FIG. 2. Thus, if a medical emergency does not actually exist, the user of warning unit 12 may override the decisions made by the medical alert analysis of the system and avoid transmission of false alarm messages.

Depending on the application, the user of warning unit 12 may require that a P.I.N. (personal identification number) be entered and verified by warning unit 12 in order to disable the alarm. This feature of warning unit 12, for example, will prevent an attacker from disabling a valid alarm. The system determines at block 172 if the user of warning unit 12 has elected to use the P.I.N. option. If the warning unit 12 has the P.I.N. option, control is passed to decision block 169. The system determines at decision block 169 if the correct P.I.N. was entered. If the correct P.I.N. is entered, control is passed to decision block 173 where the user of warning unit 12 is given the opportunity to disable the alarm. If the correct P.I.N. is not entered, the user of the unit 12 is given a predetermined number of chances to enter the correct P.I.N. If after the predetermined number of chances the user of unit 12 has not entered the correct P.I.N., control is passed to block 176 via connector A. If the user elects to disable the alarm at block 173, control is returned to block 155 to recalculate the unit's G.P.S. coordinates.

If a medical alert is not detected by the medical alert detection circuitry at block 153, control is passed to the speech detection circuitry at block 154. The speech detection circuitry at block 154 is used to determine whether or not human speech is present. If speech is recognized, control is passed to compare the speech to data stored in a speech library at block 158. The spoken words are compared with a speech library stored in memory at block 160 as illustrated in FIG. 4A. Particular or specific words stored in the library memory at block 160 determines and indicates whether an alarm or distressful situation is occurring that requires attention or immediate response. Such words, for example, might include "robbery," "rape," "help," "heart attack," or similar selected phrases indicating an emergency situation. The system determines at block 162 from the speech library if there is an emergency. If an emergency is detected, control is passed to activate alarm 162 with subsequent operation as described above.

If no speech at all or no such emergency speech is recognized, the audible sound is analyzed at block 164 for detection of gunshot sounds. If gunshot sounds are detected at block 164, control is passed to activate alarm 162. Similar to the medical alert and speech emergencies, the person using/carrying the warning unit 12 is given an opportunity to disable a false alarm of a gunshot situation. If no sounds at all or no such gunshot sounds is detected, the sound is further analyzed for other alarming/emergency loud noise at block 168. If such loud noises are detected, control is passed to activate alarm 162. Similar to the medical alert, speech emergencies, and gunshot sound emergencies, the person using/carrying warning unit 12 is provided a chance to disable a false alarm of a loud noise situation. If no sound/noise at all or no such alarming loud noise is detected, control is passed to decision block 167 to determine whether the person using/carrying the unit 12 is near emergency help.

The system uses the calculated G.P.S. coordinates at decision block 167 to determine if the user of warning unit 12 has traveled to a location that is far away from a hospital, emergency medical center, or other such emergency help. This feature of the warning unit 12 is especially beneficial to individuals who must stay within close proximity of an emergency medical center (i.e. heart attack patients) or emergency help. If the unit 12 determines that the user is in danger because he/she is not near and dangerously far away from an emergency medical center or emergency help, control is passed to block 171 to activate a warning signal. The alarm produced by warning unit 12 is in the form of an audible alarm, a vibration of warning unit 12, a visible alarm (i.e. a flashing strobe), or any combination of the above methods of alarms. If at block 167 it is determined that the individual using/carrying warning unit 12 is not in any danger, control is passed to decision block 163 in order to determine the existence of unusual/dangerous motion or location.

The unusual motion detector at block 163 operates using outputs from motion detector 53 of FIG. 2 and successive G.P.S. coordinates computed at known time intervals to detect unexpected changes in location, velocity, acceleration, deceleration, elevation, speed, etc. that may be indicative of danger. Unusual changes in location or motion dynamics is combined with sound analysis to generate alarms when the sound analysis itself would not generate such an alarm. The motion detection may itself require an alarm condition. If an unusual motion or location is detected, control is passed to decision block 165 to determine whether the unusual motion or location is okay/acceptable motion or location. For example, the user of warning unit 12 is prompted at decision block 165 to answer if he/she is in any danger due to the detected unusual/dangerous motion or location of the warning unit 12. If the user is not in danger, the warning unit 12 saves the G.P.S. coordinates of the location of the warning unit as a safe location. Thus, the warning unit 12 updates its learned traveling behavior database at block 166. If the motion or location of the unit 12 is not okay/acceptable motion or location, control is passed to activate the alarm at block 162 with subsequent operation as described above. As in the alarm situations discussed above, if unusual/dangerous motion or location is detected, the opportunity to avoid false alarms is provided by passing control to request disablement of the alarm(s) at disable block 170. If no unusual/dangerous motion or location is detected, control is returned to block 155 to recalculate the unit's G.P.S. coordinates.

If any of the alarms at block 173 are not disabled, the G.P.S. coordinates of the warning unit 12 are calculated based on signals received from G.P.S. satellites as discussed above, and, as indicated at block 176 via connector A, the G.P.S. coordinates are read at block 176 of FIG. 4B. The alarm message is then transmitted at block 178 of FIG. 4B including the nature of the detected signal and the G.P.S. coordinates indicating the location of the warning unit 12. At block 180, confirmation of a received response by the control alarm and warning monitor/response center 10 of FIG. 1 from the unit 12 is determined. If no response is received from the control center 10 to the unit 12, control is diverted to block 177 for a delay of a predetermined amount of time "T." Control is returned to block 176 to recalculate G.P.S. coordinates and then retransmit an alarm message at block 178. Recalculation of G.P.S. coordinates permits updating the alarm message in the event of any further movement or high speed movement of the warning unit 12. When a response is finally received from the central alarm and warning monitor/response center 10 of FIG. 1 by the unit 12, control is passed to provide audio announcement at block 182 of FIG. 4B. The audio announcement will cause transmission of recorded or received messages to be output through speaker 62 of warning unit 12 as shown in FIG. 2. These messages will serve to inform the user of warning unit 12 that help is on the way and also to issue warning to an attacker or to provide instructions for emergency medical assistance (i.e. instructions for a diabetic in need of medication etc.) or emergency help. Furthermore, if the unit 12 is determined to be dangerously far away from emergency help at block 167 or if unusual/dangerous motion or location has been detected, then control is passed to block 182 via connector B for providing audio warning/notification announcement to the unit 12 of such events occurring.

Figure 5A:
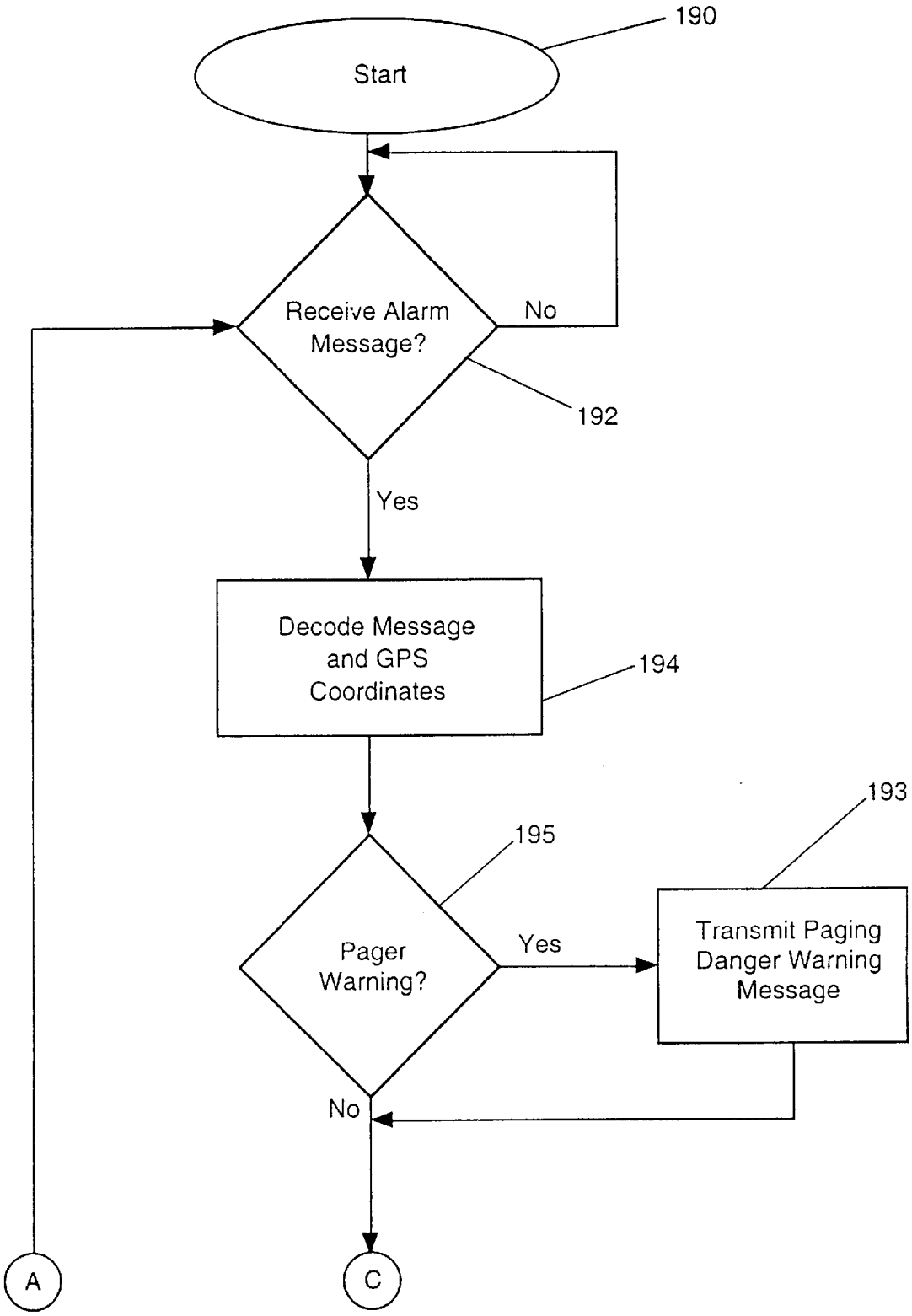
FIGS. 5A and 5B are a high level logic flow chart for the operation of the central alarm and warning monitor/response center of FIG. 3 in response to messages received from the unit of FIG. 2.
Figure 5B:
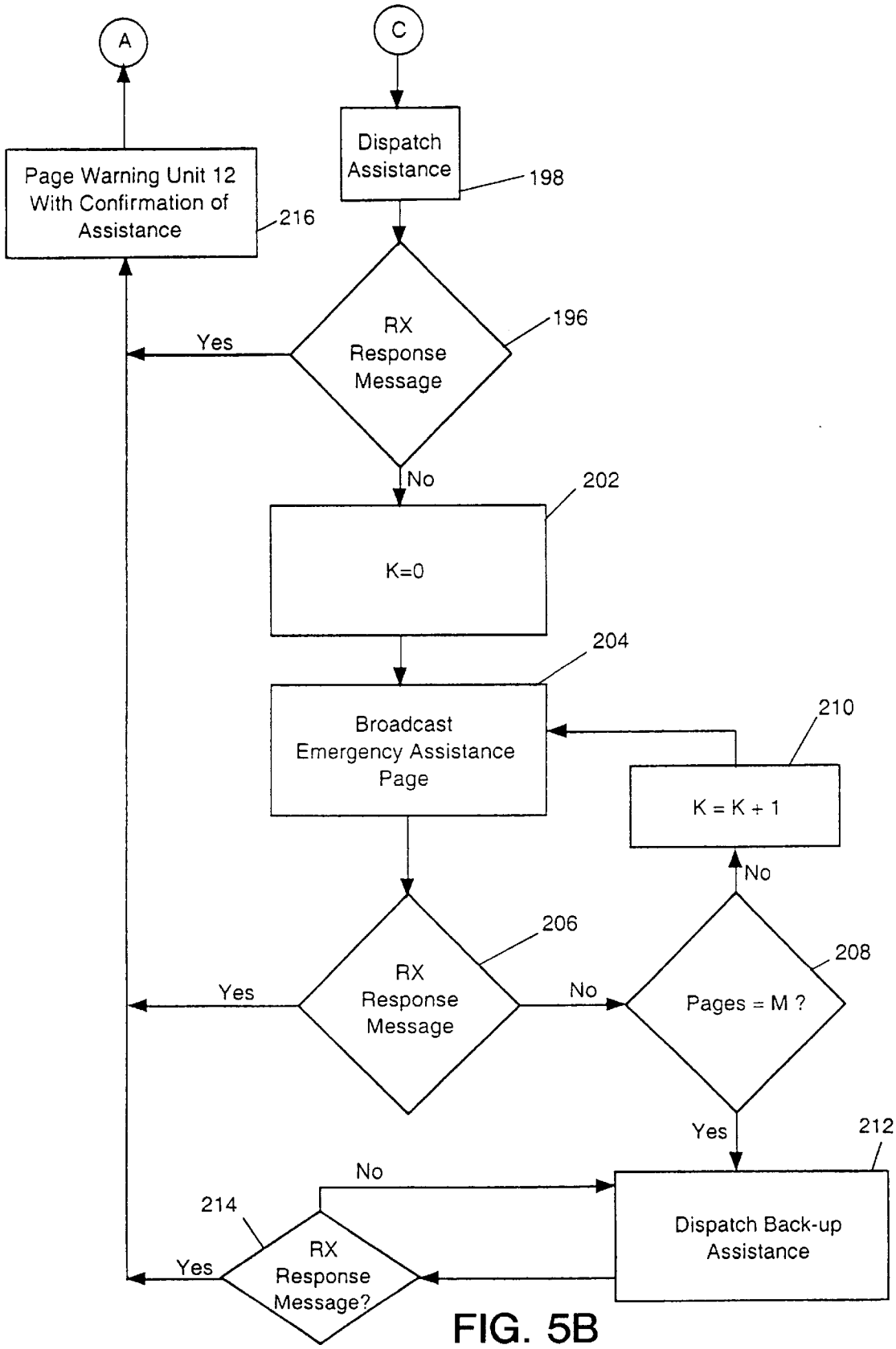

FIGS. 5A and 5B provide a high level flow chart for the operation of central alarm and warning monitor/response center 10 of FIG. 1 in response to a received alarm message generated by warning unit 12 as described in conjunction with FIGS. 4A and 4B. Operation of FIGS. 5A and 5B begins at start block 190. The system continually searches for received alarm messages from unit(s) 12 at block 192 as indicated in FIGS. 5A and 5B. The messages and G.P.S. coordinates transmitted from each warning unit 12 are decoded at block 194 as shown in FIGS. 5A and 5B.

An immediate decision is made at block 195 indicating whether or not a generalized danger warning message should be transmitted via the paging network to alert other users/carriers of warning units 12 as shown in FIG. 1 of the dangerous situation indicated by the received message. As taught in co-pending application Ser. No. 08/844,029, incorporated herein by reference, fuzzy logic and expert systems are used to determine measures of degrees of danger. If a generalized danger warning is to be transmitted, control is diverted to block 193 where the paging message is transmitted. The message transmitted via the paging network of FIG. 1 include the G.P.S. coordinates of the received message as determined at block 194 of FIGS. 5A and 5B. If a generalized danger warning is not to be transmitted, control continues to block 198 via connector C where assistance or emergency response is dispatched. At block 198, the appropriate emergency assistance or response personnel (i.e. police, fire, ambulance, swat team, etc.) is contacted by the system, and the system dispatches the personnel to the location of the emergency. The location, availability, and capability of appropriate emergency response units 20 are stored in the data base storage 104 of FIG. 3. Based on whether or not a response message is received from the emergency personnel, the system confirms at block 196 that the assisting mobile unit 20 is available and emergency personnel will be able to immediately respond. If a response message is received from the emergency personnel, control is diverted to block 216 where the system pages or communicates with warning unit 12 and confirms that emergency assistance or response is en-route to the emergency.

If a response message is not received at block 196, control is passed to unit 202 where an index "K" is set equal to zero. Control is then passed to block 204 for broadcasting an emergency assistance/response page. This paging signal is intended to illicit a response from emergency assistance/response personnel that may be in the vicinity or area of the warning unit 12 that issued the original distress message. As indicated in FIG. 5B, the monitor center 10 checks for responses to the paging message at unit block 206. If no response to the page is received after a designated time, a check is made to see whether or not "M" paging messages have yet been sent at block 208. If the pre-determined "M" number of tries have not been made, control is passed to unit 12 at block 210 and "K" is increased by one with control being passed back to the broadcast emergency assistance page block 204 for retransmission of the emergency assistance/response paging message. The retransmission continues until either a response is received at block 206 or a total of "M" tries have been made as indicated in FIG. 5B. If a response is received, control is passed to block 216 to confirm that emergency assistance/response is en-route to the location of the emergency.

Returning now to block 208, if after "M" attempts, no response is received to the broadcast emergency assistance/response page, control is passed to dispatch back-up assistance/response block 212 where assistance/response is dispatched even though it may take longer to reach the location of the warning unit 12 than it would have if responded to at the time the alarm message was originated. Attempts to contact back-up assistance/response are continued (i.e. control loops to block 212) until a response message is received at block 214 from emergency personnel. Once a response message is received at block 214, control is passed to block 216 which sends a confirmation message to warning unit 12 that will inform the user of the warning unit that emergency assistance/response is en-route. Control center 10 continuously communicates with and monitors all units 12, and therefore, the operation of the control center 10 of FIGS. 5A and 5B is continuous. The operation would cease only if the control center 10 were shut down.

Figure 6:
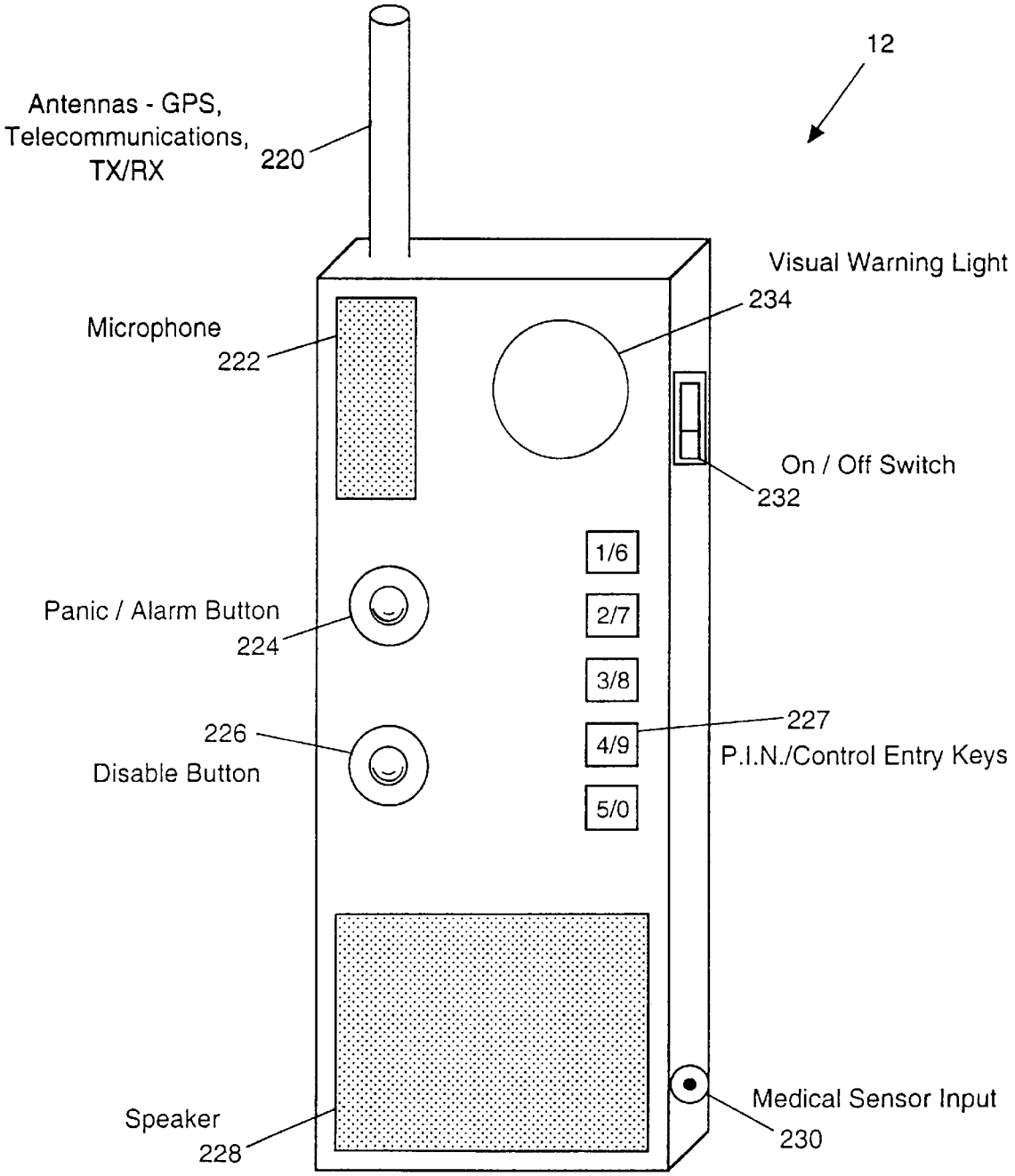
FIG. 6 depicts a portable warning alarm unit in accordance with the present invention.

FIG. 6 depicts a preferred embodiment of warning unit 12. The warning unit 12 is designed to be carried by an individual in a convenient manner. The size of warning unit 12 is similar to that of a modem day telecommunications pager, cellular telephone, or a traditional walkie-talkie. FIG. 6 displays the external features of warning unit 12. The antenna port 220 comprises different antennas (G.P.S., telecommunications, TX/RX etc.) needed by the warning unit 12. An external microphone 222 is provided for communication with the central alarm warning monitor/response center 10 and to detect emergency sounds or alarming noises (i.e. gunshots, recognized speech, etc.). The panic/alarm button 224 is provided for the user to manually activate a request for assistance. The disable button 226 is provided in conjunction with P.I.N./control entry keys 227 so that the user of warning unit 12 is able to deactivate any false alarms. The speaker 228 is used for communication from the monitor/response center 10 and to the user of warning unit 12. The speaker 228 is capable of producing alarms or speech. The medical sensor input 230 is provided to enable the medical sensor (i.e. heart monitor, respiratory monitor, blood level monitor, circulatory monitor, nervous system monitor, etc.) to communicate with the warning unit 12. The on/off switch 232 is used to turn the warning unit on and off. The visual warning light 234 is used as another form of communication between the monitor/response center 10 and the user of warning unit 12. Whenever there is any type of communication between the monitor/response center 10 and the user of warning unit 12 (i.e. safety warning, medical emergency, etc.), the visual warning light flashes to gain attention of the user.

FIG. 7 is a grid diagram of an area (i.e. an entire city) of normal travel for the user of warning unit 12. The numbers inside the grid indicate how many times the user of warning unit 12 has visited a particular sector. The data in FIG. 7 is normalized in various well known ways to indicate, for example, percentage of times spent in an area or visits to a particular area in a specified time such as a week, month, year, etc. For example, the diagram shows that the user of warning unit 12 has visited sector D3 at least 1,000 times and that he/she has never visited sector F1. In order to update the learned traveling behavior database, the warning unit 12 in conjunction with the central control center 10 continually monitors and records the location of the warning unit 12. The learned travel behavior database uses this data to calculate a normal pattern of traveling behavior for the user of warning unit 12. For example, the figure shows that the user of warning unit 12 being monitored has never traveled to sector F1. If the user of the warning unit 12 were to travel to that sector, the warning unit 12 and control center 10 would detect a possible emergency and activate an alarm. If the user responds to the alarm and notifies the control center the he/she is okay, then the database saves the G.P.S. coordinates as a safe place; thus, the present invention learned a new characteristic about the user of warning unit 12. If the user does not respond or if the user notifies the control center that he/she is in danger, then the control center dispatches the proper emergency response units.

Similarly, the invention uses the grid system to determine if it is necessary to transmit a paging message to the user of a warning unit 12 that may travel to a sector in which there is a degree of danger. For example, if a user of the warning unit 12 is in sector A4 and frequently travels to sector C3 and if a homicide just occurred in sector C3, the control center 10 will transmit a message to the user of warning unit 12 in order to inform him/her of the danger that exists in a sector to which he/she frequently travels. If the danger exists in sector F1, it is not necessary to inform the user of warning unit 12 of the danger because the control center 10 concludes from the learned information in the intelligent database that the user of the warning unit 12 will most likely not be traveling to sector F1.

The inventions set forth above are subject to many modifications and changes without departing from the spirit, scope or essential characteristics thereof. Thus the embodiments explained above should be considered in all respect as being illustrative rather than restrictive of the scope of the inventions as defined in the appended claims. For example, the detection and monitoring operations may be carried out using a wide variety of sensing and monitoring equipment. Similarly the various computer operations, fuzzy logic operations, and expert system operations described herein may vary depending upon the particular computer, fuzzy logic, and expert system structures and algorithmic approaches selected. Also, the present invention is not limited to being used with global positioning system satellites as disclosed above and may make use of any types of locating systems or satellite positioning system for determining geographic locations. The present invention is not limited to using the communications (i.e. transmitters, receivers, telecommunications, paging, radio, etc.) and interfacing systems disclosed above and any suitable communications/interfacing systems may be used with the present invention. Additionally, the present invention is not limited to the control center 10 and warning unit(s) 12 as specifically disclosed herein, and any suitable control center and warning unit may be made part of and used with the present invention. Furthermore, the present invention is not limited to detecting and generating alarms based on geographic locations, geographic locations relative to emergency help, variation from normal behavior patterns, dangerous situation occurring at frequently visited location, unusual/dangerous motion or location, medical conditions, sound recognition, other information received (i.e. weather reports, police radio, auxiliary information sources, etc.), information from other users of units 12, etc., and any suitable methods and ways of detecting and generating alarms may be used with the present invention. Also, the present invention is not limited to determining the degree of danger for a person as specifically disclosed herein, and any suitable method for making that determination may be used with the present invention.

We claim:

1. A system for monitoring a geographic person location, periodically warning a person of emergency situations in the geographic location, and transmitting requests for assistance in emergency situations comprising:

(a) a portable warning unit that is carried by the person, the portable warning unit including: (1) a satellite receiver that receives and analyzes communication signals from a satellite positioning system and determines a current geographic location of the person; (2) a receiver circuit that receives broadcasted warning signals defining dangerous situations and geographic situation locations of the situations; (3) a computer controller including a processor and a memory, wherein the processor is configured to monitor and store in the memory data defining the geographic person location as the person moves from location to location over a period of time, and to compare the geographic person location with location information from the received warning signals to determine a degree of danger for the person carrying the portable warning unit; (4) an alarm indicator that indicates when the person is in danger; and (5) a transmission circuit that generates and transmits signals requesting assistance and signals warning of the dangerous situations in a vicinity of the person carrying the portable warning unit along with the current geographic location of the person (b) a command center including: (1) a database computer having a database storage unit and configured to monitor and track an existence and status of emergency situations and locations of emergency response centers and units in a geographic region; (2) a transmitter for broadcasting emergency warning signals corresponding to dangerous situations along with the geographic situation locations; (3) a receiver for receiving emergency assistance requests and signals indicating existence of dangerous situations; and (4) a transmitter for transmitting signals to emergency response units and centers;

(c) wherein: (1) the receiving circuit of the portable warning unit carried by the person receives the signals transmitted from the command center that are indicative of a dangerous situation and a geographic situation location; (2) the computer controller of the portable warning unit compares the geographic person location with the geographic situation location indicated in the received signal from the command control center, and using expert system rules determines a degree of danger index for the person carrying the portable warning unit; (3) generates a warning signal for the person carrying the warning unit; and (4) the portable warning generates and transmits signals requesting emergency assistance and warning of emergency situations along with signals indicating a location of the portable warning unit.

2. The system of claim 1 comprising a plurality of portable warning units carried by a plurality of persons, and the command center is configured to broadcast warning signals to be simultaneously received by the portable warning units within radio signal range of the command control center.

3. The system of claim 1 wherein the satellite positioning system is a Global Positioning System, the satellite receiver of the warning unit is compatible with the Global Positioning System, and the current geographic position of the person is defined by Global Positioning System coordinates of the person.

4. The system of claim 1 wherein the computer controller of the portable warning unit comprises a fuzzy logic controller and the portable warning unit expert system rules comprise fuzzy logic inference rules in order to compute the degree of danger index for the person carrying the portable warning unit.

5. The system of claim 4 wherein the fuzzy logic controller generates and stores data defining normal behavior patterns of the person wearing the portable warning unit in the memory of the computer controller.

6. The system of claim 5 wherein the computer controller of the portable warning unit compares the data stored in the memory defining the normal behavior patterns to the data defining the current geographic location of the person wearing the warning unit, and if a predefined variance exists between the data defining the current geographic location and the data defining the normal behavior patterns, an alarm signal is generated and transmitted to the command control center.

7. The system of claim 4 wherein the computer controller of the portable warning unit generates and stores data defining dangerous areas for persons to travel.

8. The system of claim 7 wherein the computer controller of the portable warning unit compares the data stored in the memory defining the dangerous areas to the data defining the current geographic location of the person wearing the warning unit, and if the person is in a dangerous area, an alarm signal is generated and transmitted to the command control center.

9. The system of claim 4 wherein the warning unit carried by the person further includes a medical monitoring system that monitors and generates signals defining selected current medical conditions of the person wearing the portable warning unit.

10. The system of claim 9 wherein the portable warning unit computer controller memory includes data defining normal medical conditions, the computer is programmed to compare the signals generated by the medical monitoring system to the data stored in the memory defining abnormal medical conditions, and if a variance of predefined degree exists between the current medical conditions and the normal medical conditions, the computer generates and causes the transmission circuit to transmit signals defining the variance to the command control center.

11. The system of claim 10 wherein the medical monitoring system detects the normal medical conditions for blood condition of the person, the medical monitoring system alerts the command control center of the geographic person location and the current medical conditions, and the command control center determines emergency severity of the current medical conditions and dispatches proper emergency assistance.

12. The system of claim 10 wherein the medical monitoring system detects the normal medical conditions for circulatory system of the person, the medical monitoring system alerts the command control center of the geographic person location and the current medical conditions, and the command control center determines emergency severity of the person and dispatches proper emergency assistance.

13. The system of claim 10 wherein the medical monitoring system detects the normal medical conditions for respiratory system of the person, the medical monitoring system alerts the command control center of the geographic person location and the current medical conditions, and the command control center determines emergency severity of the person and dispatches proper emergency assistance.

14. The system of claim 10 wherein the medical monitoring system detects the normal medical conditions for nervous system of the person, the medical monitoring system alerts the command control center of the geographic person location and the current medical conditions, and the command control center determines emergency severity of the person and dispatches proper emergency assistance.

15. The system of claim 4 wherein the portable warning unit carried by the person further includes a sound recognition system configured to recognize and generate electrical signals defining selected sounds.

16. The system of claim 15 wherein the memory of the computer controller includes data defining select emergency conditions, the computer is programmed to compare the signals generated by the sound recognition system to the data defining the select emergency conditions, and if one of the select emergency conditions exists, the computer generates and causes a transmission circuit to transmit signals defining the one of the select emergency conditions to the command control center.

17. The system of claim 16 wherein the sound recognition system comprises a speech recognition circuit and the selected sounds comprise words spoken by the person wearing the warning unit.

18. The system of claim 17 wherein the sound recognition system detects specific pre-programmed speech, the warning unit alerts the central command center, and the central command center dispatches appropriate distress assistance to the person.

19. The system of claim 16 wherein the sound recognition system detects loud noises, riot sounds, or gunshots, the warning unit alerts the central command center, and the central command center dispatches the appropriate distress assistance to the person.

20. The system of claim 4 wherein the command control center receives the transmitted signals from the portable warning unit generated using fuzzy logic and defining an emergency condition based on the degree of danger index for the person and wherein the command control center generates and transmits signals to an emergency response unit defining type of the emergency condition, the fuzzy logic degree of danger, and the current geographic person location.

21. The system of claim 1 wherein the command center transmits to the portable warning unit warning messages based on information received from weather reports, police radio, and other auxiliary information sources.

22. The system of claim 1 wherein the command center transmits warning messages to persons carrying warning units based on information received from other persons carrying portable warning units.

23. The system of claim 4 wherein the computer controller of the portable warning unit generates and stores data defining dangerous types of motion based on the received warning signals.

24. The system of claim 23 wherein the dangerous type of motion being generated and stored by the portable warning unit is dangerous acceleration, the warning unit alerts the central command center of the dangerous acceleration, and the central command center dispatches appropriate distress assistance to the person.

25. The system of claim 23 wherein the dangerous type of motion being generated and stored by the portable warning unit is a dangerous change in elevation, the warning unit alerts the central command center of the dangerous change in elevation, and the central command center dispatches appropriate distress assistance to the person.

26. The system of claim 23 wherein the dangerous type of motion being generated and stored by the portable warning unit is a dangerous speed, the warning unit alerts the central command center of the dangerous speed, and the central command center dispatches appropriate distress assistance to the person.

27. The system of claim 23 wherein the dangerous type of motion being generated and stored by the portable warning unit is a dangerous deceleration, the warning unit alerts the central command center of the dangerous deceleration, and the central command center dispatches distress assistance to the person.

28. The system of claim 4 wherein the fuzzy logic inference rules include fuzzy variables defining a distance between the portable warning unit and the dangerous situation.

29. The system of claim 4 wherein the fuzzy logic inference rules include variables defining vulnerability of the person carrying the portable warning unit to the dangerous situation.

30. The system of claim 4 wherein the fuzzy logic inference rules include variables defining a relative velocity between the portable warning unit and the dangerous situation.

31. The system of claim 4 wherein the fuzzy logic inference rules include fuzzy variables defining a distance between the portable warning unit and the dangerous situation, a vulnerability level of the person carrying the portable warning unit to the dangerous situation, and a relative velocity between the portable warning unit and the dangerous situation.

32. The system of claim 31 wherein the fuzzy logic controller derives a fuzzy variable defining the degree of danger of the person carrying the portable warning unit and defuzzifies the fuzzy variable to derive a singular degree of danger.

33. A method for monitoring at least one person of a geographic person location, periodically warning the at least one person of emergency situations in the geographic location, and transmitting requests for assistance in emergency situations comprising the steps of:

(a) using at least one portable warning unit to monitor and communicate with the at least one person, (b) having the at least one portable warning unit interfacingly communicate with a command center, (c) receiving the at least one portable warning unit signals transmitted from the command center that are indicative of a dangerous situation and a geographic situation location, (d) comparing the geographic person location with the geographic situation location indicated in the received signal from the command control center, (e) using expert system rules to determine the dangerous situation and at least one degree of danger index for the at lease one person near the geographic situation location, (f) generating an appropriate warning signal for the at least one person when the dangerous situation has been assessed and the at least one degree of danger index has been reached, and (g) generating and transmitting signals within the appropriate warning signal that indicate requests for emergency assistance and warning of emergency situations along with signals indicating a current location of the at least one portable warning unit.

34. The method of claim 1 wherein the using expert system step further comprises the step of:

using fuzzy logic inference rules in order to compute the at least one degree of danger index for the at least one person.

35. The method of claim 34 wherein the using fuzzy logic inference rules further comprises the steps of:

defining normal behavior patterns of the at least one person, comparing the normal behavior patterns to the current location of the at least one portable warning unit, and generating and transmitting an alarm to the command center if a predefined variance exists between the data defining the current location and the normal behavior patterns.

36. The method of claim 34 further comprising the step of:

generating and storing data defining dangerous areas for persons to travel.

37. The method of claim 36 further comprising the step of:

comparing the data defining the dangerous areas to the current location of the at least one portable warning unit, and generating and transmitting an alarm signal to the command center if the at least one person is in the dangerous areas.

38. The method of claim 33 wherein the using at least one portable warning unit step further comprises the step of:

monitoring and detecting medical conditions of the at least one person using the at least one portable warning unit.

39. The method of claim 33 wherein the using at least one portable warning unit step further comprises the step of:

recognizing and detecting sounds and speech of the at least one person and near the at least one person using the at least one portable warning unit in determining the dangerous situation that the at least one person may be involved.

40. The method of claim 33 wherein the using expert system rules step further comprises the steps of:

defining an emergency condition based on the at least one degree of danger index for the at least one person, and defining type of the emergency condition, fuzzy logic degree of danger of the emergency condition, and the current location of the at least one portable warning unit.

41. The method of claim 33 wherein the generating an appropriate warning signal step further comprises the step of:

generating the appropriate warning signal based on weather reports, police radio, and other auxiliary information sources.

42. The method of claim 33 wherein the generating an appropriate warning signal step further comprises the step of:

generating the appropriate warning signal based on information received from other persons carrying other portable warning units.

43. The method of claim 33 wherein the using at least one portable warning unit step further comprises the step of:

defining and detecting types of motion of the at least one person using at least one portable warning unit.

* * * * *